United States Patent [19]

Küpper

[11] Patent Number: 4,660,368

[45] Date of Patent: Apr. 28, 1987

[54] INSTALLATION FORMED OF A SPINNING MACHINE AND A WINDING MACHINE

[75] Inventor: Wilhelm Küpper, Wegberg, Fed. Rep. of Germany

[73] Assignee: W. Schlafhorst & Co., Moenchengladbach, Fed. Rep. of Germany

[21] Appl. No.: 839,069

[22] Filed: Mar. 13, 1986

[30] Foreign Application Priority Data

Mar. 13, 1985 [DE] Fed. Rep. of Germany ..... 3508942

[51] Int. Cl.[4] ..... D01H 9/18; D01H 13/28; D06B 3/09

[52] U.S. Cl. ..... 57/281; 28/285; 57/276; 57/309; 68/5 R; 242/35.5 R

[58] Field of Search ..... 57/308, 309, 281, 266, 57/274, 276; 68/5 R, 5 B, 5 C, 5 D, DIG. 5; 28/284–286; 261/1, 94–97; 242/35.5 R

[56] References Cited

U.S. PATENT DOCUMENTS

| | | | |
|---|---|---|---|
| 2,003,911 | 6/1935 | Walker | 57/308 X |
| 2,465,130 | 3/1949 | Story | 28/285 |
| 3,154,904 | 11/1964 | Furst | 242/35.5 R X |
| 3,195,298 | 7/1965 | Furst | 242/35.5 R X |
| 3,286,320 | 11/1966 | Voronin et al. | 28/285 |
| 3,547,575 | 12/1970 | Theodores | 68/5 R X |
| 4,181,228 | 1/1980 | Hashimoto et al. | 57/276 X |

*Primary Examiner*—John Petrakes

*Attorney, Agent, or Firm*—Herbert L. Lerner; Laurence A. Greenberg

[57] ABSTRACT

An installation includes a spinning machine, a winding machine, a bobbin transporting device transporting the bobbins from the spinning machine to the winding machine, and a tube or sleeve transporting device transporting tubes or sleeves from the winding machine to the spinning machine providing a circulation of wound and unwound tubes or sleeves, the bobbin transporting device including at least one automatic yarn steaming device.

7 Claims, 2 Drawing Figures

INSTALLATION FORMED OF A SPINNING MACHINE AND A WINDING MACHINE

Figure 1:
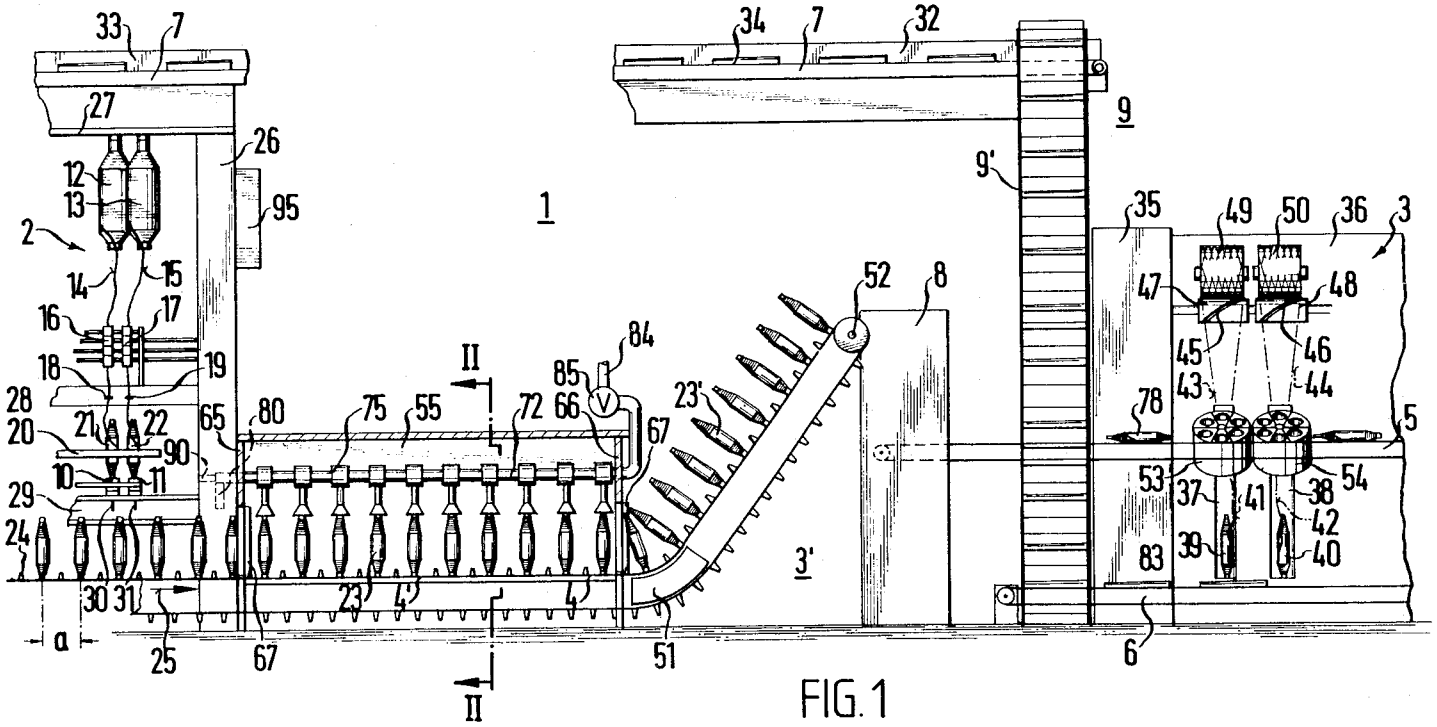

The invention relates to an installation formed of a spinning machine and a winding machine, including a bobbin transporting device for transporting the cops or bobbins from the spinning machine to the winding machine, and a tube or sleeve transporting device for transporting the tubes or sleeves from the winding machine to the spinning machine, so that a circulation of wound and unwound or empty tubes or sleeves is established.

The installation produces large volume cheeses or cross-wound bobbins, which require after-treatment bv steaming, depending on the type of fiber and the thread strength. This necessitates a separate operation in a special device. Because of the large volume of the cheeses, the required steaming apparatus is costly and the steaming process consumes a great amount of time. Furthermore the steam treatment is often unsatisfactory, because the cheeses do not receive uniform treatment, in spite of taking the utmost care.

It is accordingly an object of the invention to provide an installation formed of a spinning machine and a winding machine, which overcomes the hereianforementioned disadvantages of the heretofore-known devices of this general type and to create conditions in which the cheeses are produced with sufficiently and uniformly steamed yarn, without the need to transport the cheeses separately to a special device for this purpose.

With the foregoing and other objects in view there is provided, in accordance with the invention, an installation, comprising a spinning machine, a winding machine, a bobbin or cop transporting device transporting the bobbins from the spinning machine to the winding machine, and a tube or sleeve transporting device transporting tubes or sleeves from the winding machine to the spinning machine providing a circulation of wound and unwound or empty tubes or sleeves, the bobbin transporting device including at least one automatic yarn steaming device.

The steaming of the yarn is therefore integrated in the bobbin transporting device so that several advantages are obtained. The required expenditure for machinery is low, the bobbin volume is relatively small, the steam treatment is performed rapidly and thoroughly, and the device does not interfere with the circulation of the bobbins and the tubes or sleeves. The space requirement for this yarn steaming device is relatively small and the finished cheeses, which are quite easily damaged, do not have to be transported again to a yarn steaming device, so that damage and contamination by dirt are avoided.

In accordance with another feature of the invention, the bobbin transporting device includes bobbin carriers, and the yarn steaming device includes a multiplicity of simultaneously operating yarn steaming elements operating in combination with the bobbin carriers of the bobbin transporting device.

In accordance with a further feature of the invention, the bobbin transporting device includes at least one bobbin conveyor belt, the bobbin carriers are push-on spindles disposed on the bobbin conveyor belt, and the yarn steaming elements include steam outlet elements to be attached to the upper ends of the tubes or sleeves of the carrier bobbins.

Perforated tube sleeves are used for the steaming process. The steam enters through these perforations into the bobbins.

In accordance with an added feature of the invention, the yarn steaming device includes a housing and a suction device disposed in the housing, part of the bobbin transporting device being disposed in the housing, and the housing including entrance and exit locations for the bobbin transporting device and sealing elements opening and closing automatically at the entrance and exit locations. For example, such sealing elements may be rubber-elastic flaps, which are directly opened by contact with the bobbins that are standing on a conveyor belt and spring back into the closed position after the bobbin has passed. It is not necessary to achieve a hermetic closure by this construction.

In accordance with an additional feature of the invention, the housing includes a bottom and the bobbin transporting device includes a bobbin conveyor belt having an upper run conducted in sealing grooves formed in the bottom of the housing of the yarn steaming device. In this case as well, a hermetic closure is not required. The guiding of the upper portion of the belt in sealing grooves also has the additional advantage of providing the bobbins with an especially stiff support, especially if the conveyor belt is formed of a strong material, such as steel.

In accordance with again another feature of the invention, the bobbin transporting device travels through the yarn steaming device, and including means for operating the yarn steaming device discontinuously and for stopping the bobbin transporting device during a yarn steaming operation. A discontinuous yarn steaming device can be constructed with simpler means than a continuous device. A favorable factor provided by this construction is that the steaming process only takes a short time and therefore the transport means does not stand still for a long time. After the steam treatment of a batch is finished, the transporting means advances through the width of one batch. The next yarn steaming operation then occurs, and so on.

In accordance with again a further feature of the invention, the spinning machine is double-sided as is usual, and including another yarn steaming device, the bobbin transporting device including a separate bobbin conveyor belt and one of the yarn steaming devices for each side of the double-sided spinning machine.

The two bobbin conveyor belts as well as the two yarn steaming devices may operate independently of each other. As a whole, an everage uniform output of steamed bobbins is thus obtained, with the exception of the two yarn steaming devices accidentally operating synchronously for a short time.

In accordance with again an added feature of the invention, there are provided automatic switching and control means for alternatingly operating the yarn steaming devices of the two machine sides. This avoids synchronous operation.

In accordance with again an additional feature of the invention, the two yarn steaming devices include a common middle wall, a steam pipe disposed in the common middle wall swiveling about a longitudinal axis thereof, two pipes branching from the steam pipe and having ends, and respective rows of yarn steaming elements disposed at the ends of the two pipes, the automatic switching and control means lifting the yarn steaming elements of one machine side off the ends of the tube sleeves when the yarn steaming elements of the other machine side are near the ends of the tube sleeves. This provides alternating operation of the yarn steaming devices.

In accordance with a concomitant feature of the invention, there is provided a bobbin buffer storage device disposed between the yarn steaming device or devices and the winding machine. This avoids disturbances during the rapid circulation of the tubes or sleeves. The buffer storage device need only be large enough so that it can quickly accept a batch of steamed bobbins, in order to later transfer them slowly or according to the need of the winding machine. The bobbin buffer storage device can also be a part of a bobbin preparation station, wherein the thread ends may be placed into the tube sleeves in such a way that the thread ends can be more easily located and gripped at the winding machine.

Other features which are considered as characteristic for the invention are set forth in the appended claims.

Although the invention is illustrated and described herein as embodied in an installation formed of a spinning machine and a winding machine, it is nevertheless not intended to be limited to the details shown, since various modifications and structural changes may be made therein without departing from the spirit of the invention and within the scope and range of equivalents of the claims.

Figure 2:
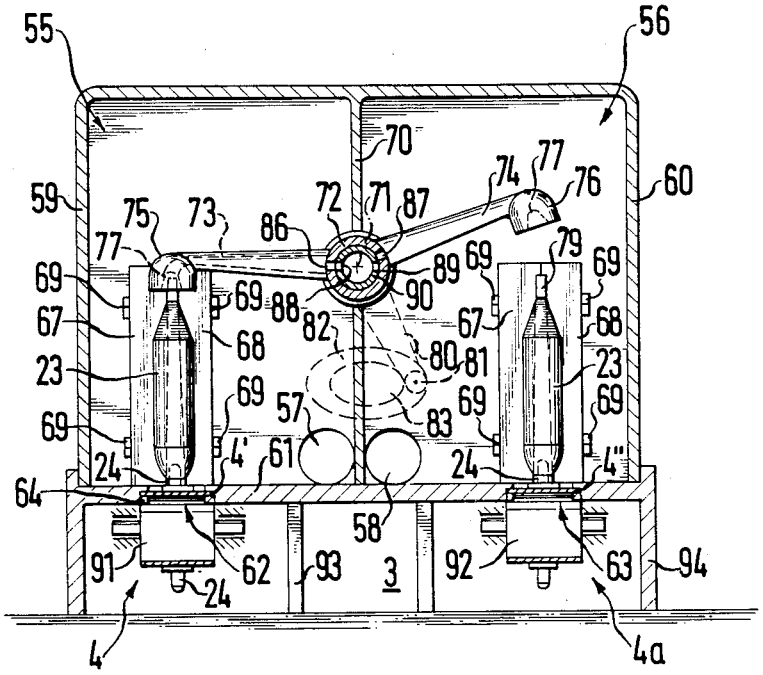

The construction and method of operation of the invention, however, together with additional objects and advantages thereof will be best understood from the following description of specific embodiments when read in connection with the accompanying drawings, in which:

FIG. 1 is a fragmentary, diagrammatic, side-elevational view of an installation formed of a spinning machine and a winding machine; and FIG. 2 is a cross-sectional view taken along the line II—II in FIG. 1 in the direction of the arrows.

Referring now to the figures of the drawings in detail as a whole, there is seen an installation which is designated with reference numeral 1 as a whole and which is formed of a spinning machine 2 and a winding machine 3. The installation 1 includes a bobbin or cop transport device for transporting bobbins or cops 23, 23', 78, which is designated with reference numeral 3' as a whole. The transport device moves the bobbins from the spinning machine 2 to the winding machine 3. The bobbin transport device 3' includes bobbin transporting means in form of a bobbin conveyor belt or transport band 4 and additional bobbin transporting means in form of a bobbin conveyor belt or transport band 5. The bobbin conveyor belt 4 is disposed at the spinning machine 2 and the bobbin conveyor belt 5 is disposed at the winding machine 3. The bobbin conveyor belt 4 ends at a bobbin buffer storage device 8, which transfers the stored bobbins to the conveyor belt 5 in sequence, one after the other.

Furthermore, the installation 1 includes a bobbin tube or sleeve transport device designated as a whole with reference numeral 9, which is formed of a bobbin tube or sleeve conveyor 6, a bobbin tube or sleeve conveyor 7, and an elevator 9' which leads from the conveyor 6 to the conveyor 7.

Only two spinning stations 10 and 11 of the numerous spinning stations of the spinning machine 2 are illustrated. Two rovings 14, 15 are conducted from two roving bobbins 12, 13 through two drawing frames 16, 17, through two thread eyes 18, 19 and through a ring rail 20 to the two bobbins 21, 22, which are being formed. Additional bobbins 23 and 23' which were previously made, are positioned on bobbin carriers 24 of the conveyor belt 4. The bobbin carriers 24 are constructed in the form of spindles or pins. After a control command, the upper run or part 4' of the bobbin conveyor belt 4 can advance through ten bobbin increments and then stop for the time period required for a yarn steaming process.

An end frame 26 of the spinning machine 2 serves as a support for various traverses 27, 28, 29 and at the same time houses drives of the drawing frames, the ring bank and spindles 30, 31.

The tube or sleeve conveyor 7 is constructed in the form of an overhead conveyor belt conducted above the spinning machine 2, which is provided with side walls 32, 33, so that tubes or sleeves 34 are oriented in the longitudinal direction, and remain in that position.

An end frame 35 and a rear wall 36 of the spinning machine 3 are shown. Only winding stations 37 and 38 of a total of ten winding stations are shown. Threads 41, 42 come from bobbins 39, 40 serving as run-off spools and each form a respective traversing triangle 43, 44. The threads are conducted through reversing thread grooves 45, 46 of two winding rollers 47, 48 and reach cheeses or cross-wound bobbins 49, 50 being formed, which lie on and are driven by the winding rollers.

The supply of run-off bobbins is provided by the bobbin conveyor belt 5. A limited number of run-off bobbins is stored at each winding station 37, 38 in a round magazine 53, 54. The bobbins are replenished by moving a non-illustrated deflector into the transport path of the conveyor 5, in order to deflect a bobbin into the respective round magazine.

Since the spinning machine 2 is double-sided, an additional, similar bobbin conveyor belt **4*a* is disposed at the rear of the machine at the same height as the belt 4, as seen in FIG. 2. The bobbin conveyor belt 4*a* also ends at the bobbin buffer storage device 8. For this purpose, according to FIG. 1, both conveyor belts 4 and 4*a* are provided with a guiding device 51 which permits the transport at a higher level, and drive rollers 52** at the high end.

Since the bobbin conveyor belt **4*a* also belongs to the bobbin transport device 3', the bobbin transport device is provided with two automatic yarn steaming devices 55 and 56, as seen in FIG. 2. Each of the yarn steaming devices 55 and 56 has a housing 59, 60 which is connected to a respective suction device 57, 58. The suction devices 57 and 58 end at non-illustrated exhausters. The yarn steaming devices 55 and 56 are provided with a common bottom 61 having openings 62 and 63 formed therein, which perforate the bottom in the longitudinal direction. The edges of the openings 62 and 63 are provided with sealing grooves 64, in which respective runs or parts of the conveyor belts 4 and 4*a* are guided. Common end walls 65, 66 of the yarn steaming devices 55, 56 shown in FIG. 1, have sealing elements 67, 68 at entrance and exit locations of the conveyor belts 4, 4*a***, which automatically open and close.

According to FIG. 2, the sealing elements 67, 68 are formed of rubber-elastic flaps which are attached to hinges 69. Due to their elasticity, the sealing elements always have a tendency to cling to each other and therefore to seal the end walls 65, 66, respectively. Bobbins passing these sealing elements 67, 68 in the transport direction open the sealing elements relatively easily as the bobbins displace the sealing elements, as indicated in FIG. 1.

According to FIG. 2, a steam pipe 72 is disposed in a common middle wall 70 of the two yarn steaming devices 55, 56. The steam pipe 72 can swivel on a central pipe 90. Respective pipes 73, 74 branch off from the steam pipe 72 toward both sides. Two respective rows of yarn steaming elements 75, 76 are disposed at the ends of these pipes. The yarn steaming elements 75, 76 are constructed in the form of steam outlet elements with conical outlet orifices 77.

The distance from one respective yarn steaming element 75, 76 to the other is equal to a bobbin spacing or division a. For steaming, the yarn steaming elements 75, 76 work in conjunction with the bobbin carriers 24 of the transport device 3' and the bobbin conveyor belts 4, 4a thereof in the following manner:

The conveyor belts 4, 4a are stopped in such a way that the bobbin carriers or spindles 24 with the bobbins are positioned exactly below the yarn steaming elements 75, 76, respectively. In the embodiment of the yarn steaming device 55 which is used as an example, the outlet orifices 77 fit in an accurate and sealing manner onto the upper end of the tubes or sleeves 79 of the bobbins 23, after the yarn steaming elements 75, 76 have been placed onto the upper ends of the tubes or sleeves, as shown in FIG. 2.

According to FIG. 2, the respective yarn steaming elements 75, 76 are disposed relative to the bobbins 23 in such a manner that the steaming elements at one side of the machine are lifted from the tube sleeves 79 when the yarn steaming elements at the other side of the machine are near the ends of the tubes or sleeves. For example, according to FIG. 2 the yarn steaming elements 76 at the rear side of the machine are lifted up from the tube or sleeve ends 79, while the yarn steaming elements 75 at the front side of the machine are near the ends of the tubes or sleeves.

In this case, the shifting means required for the alternating approach of the respective yarn steaming elements 75, 76 are formed of a lever 80, which is outside the housing connected to the steam pipe 72. A roller 81 which is rotatably disposed at the end of the lever engages in a guide groove 82 of a cam disc 83. Depending on the position of the cam disc, either the yarn steaming elements 75 are in contact with the bobbins at the anterior machine side or the yarn steaming elements 76 are in contact with the bobbins at the posterior machine side.

According to FIG. 1, the steam supply into the steam pipe 72 is provided through a steam line 84, which originates from a non-illustrated steam generator. The steam line 84 can be closed by means of a valve 85. In order to ensure that only the contacting yarn steaming elements are supplied with steam, the steam pipe 72 functions like a rotary slide valve. The pipes 73, 74, respectively, are only supplied with steam if respective openings 86, 87 in one of the two respective pipes 73, 74 on the steam pipe 72, are aligned with openings 88, 89, respectively, in the central steam pipe 90 which is fixed in position and connected with the steam line 84.

FIG. 1 shows that the central pipe 90 is fastened to the wall of the end frame 26, and thus also serves as a support tube or member.

The bobbin buffer storage device 8 shown in FIG. 1, can have a conventional construction. For example, it can take the form of a chute magazine, with a bottom which is formed by the bobbin conveyor belt 5. However, as already mentioned, the bobbin buffer storage device 8 can be a bobbin preparation station, which takes over the buffer function. Deflection rollers 91, 92 of the bobbin conveyor belts 4, 4a are disposed at the rear end of the respective conveyor belts, between the upper and lower runs or parts of the bobbin conveyor belts, which can be conducted through sliding guides. FIG. 2 also indicates that the automatic yarn steaming devices 55 and 56 rest on stable supporting structures 93, 94, respectively.

The installation according to the invention operates as folows:

The bobbin conveyor belts 4 and 4a at both sides of the spinning machine 2 are supplied with bobbins 23. The motion of the two conveyor belts 4 and 4a and all of the motions of the working or operating elements of the two automatic yarn steaming devices 55 and 56 are controlled by a central control device 95, which is located in the end frame 26 of the spinning machine 2. For example, the control device 95 may include slowly rotating cam groups, which are in contact with means for giving commands and which may electrically transfer their control commands to the individual working or operating elements, so that a programmed steaming process is performed in approximately the following way:

Initially, the upper run or part 4' of the bobbin conveyor belt 4 moves forward through ten bobbin positions in the direction of an arrow 25, so that ten bobbins 23 are moved into the yarn steaming device 55, as shown in FIG. 1. At this point, the conveyor belt 4 is stopped and the bobbins are positioned exactly below the ten yarn steaming elements 75. The control device 95 then rotates the cam disc 83 shown in FIG. 2 through 90 degrees, until it occupies the position shown in FIG. 2. The yarn steaming elements 75 therefore lower themselves onto the upper ends of the tubes or sleeves of the bobbins 23 at the left side of FIG. 2 and the openings 86 and 88 are simultaneously aligned. When this is accomplished, the valve 85 is opened by the control device 95 and steam flows into all ten tubes or sleeves of the bobbins. The steam penetrates the bobbins 23 from the inside out, then flows into the housing 59 and is sucked-off by the suction device 57. During this procedure, the sealing elements 67, 68 are closed. At the same time that the valve 85 is opened, the bobbin conveyor belt 4a is set in motion, and its bobbins 23 move under the yarn steaming elements 76 as soon as the conveyor belt 4a has progressed ten bobbin spaces a. After this has happened, the sealing elements 67, 68 automatically close the housing 60. The ten bobbins at the right side of the machine are then ready for the steaming process.

After a predetermined steaming time, the control device 95 closes the valve 85 and moves the cam disc 83 again, which results in moving the steam pipe 72 and its branch pipes 73 and 74 clockwise. The connection between the yarn steaming elements 75 and the tubes or sleeves of the bobbins 23 at the left side of the machine is thus broken and the yarn steaming elements 76 are positioned on the upper ends of the tubes or sleeves of the bobbins 23 at the right side of the machine. While the bobbins 23 progress into the housing 60, the previously treated bobbins move ahead in the direction toward the bobbin buffer storage device 8.

The above-described operational cycle then repeats at the other yarn steaming device 56, while being similarly controlled by the control device 95.

In this way, the two automatic yarn steaming devices 55 and 56 operate in an alternating rhythm. While the steaming operation takes place at one side of the machine, the steamed bobbins at the other side travel upward and are transferred to the bobbin buffer storage device 8.

Obviously, each of the drive rollers 52 of the conveyor belts 4 and 4*a* have a drive motor which is controlled by the control device 95, and the controllable cam disc 83 also has such a drive motor. The tube or sleeve conveyors 6 and 7 can be constructed for continuous operation, and the same applies for the elevator 9', which receives the empty tubes or sleeves 83 from the tube or sleeve conveyor 6, lifts them up, and transfers them to the tube or sleeve conveyor 7, which is disposed on top. In a manner which is not further described, the conveyor 7 transfers the tubes or sleeves at the other end of the spinning machine to the two conveyor belts 4 and 4*a*. The conveyor belts conduct the empty tubes or sleeves to the individual spinning stations 2, where they are picked up to serve as the cores for the bobbins. However, the method of supplying the tubes or sleeves to the spinning stations may also be different. Nevertheless, in every case there is a circulation of wound and empty tubes or sleeves between the winding machine and the spinning machine.

I claim:

1. Installation, comprising a spinning machine, a winding machine, a bobbin transporting device transporting the bobbins from said spinning machine to said winding machine, and a tube or sleeve transporting device transporting tubes or sleeves from said winding machine to said spinning machine providing a circulation of wound and unwound tubes or sleeves, said bobbin transporting device including at least one automatic yarn steaming device, said yarn steaming device including a housing and a suction device disposed in said housing, part of said bobbin transporting device being disposed in said housing, and said housing including entrance and exit locations for said bobbin transporting device and sealing elements opening and closing automatically at said entrance and exit locations.

2. Installation according to claim 1, wherein said bobbin transporting device includes bobbin carriers, and said yarn steaming device includes a multiplicty of simultaneously operating yarn steaming elements operating in combination with said bobbin carriers of said bobbin transporting device.

3. Installation according to claim 2, wherein said bobbin transporting device includes at least one bobbin conveyor belt, said bobbin carriers are push-on spindles disposed on said bobbin conveyor belt, and said yarn steaming elements include steam outlet elements to be attached to the upper ends of the tubes or sleeves of the carried bobbins.

4. Installation according to claim 1, wherein said housing includes a bottom and said bobbin transporting device includes a bobbin conveyor belt having an upper run conducted in sealing grooves formed in said bottom of said housing of said yarn steaming device.

5. Installation according to claim 1, wherein said bobbin transporting device travels through said yarn steaming device, and including means for operating said yarn steaming device discontinuously and for stopping said bobbin transporting device during a yarn steaming operation.

6. Installation according to claim 1, including a bobbin buffer storage device disposed between said yarn steaming device and said winding machine.

7. Installation, comprising a spinning machine, a double-sided winding machine, a bobbin transporting device transporting the bobbins from said spinning machine to said winding machine, a tube or sleeve transporting device transporting tubes or sleeves from said winding machine to said spinning machine providing a circulation of wound and unwound tubes or sleeves, said bobbin transporting device including at least one automatic yarn steaming device, another yarn steaming device, said bobbin transporting device including a separate bobbin conveyor belt and one of said yarn steaming device for each side of said double-sided spinning machine, and automatic switching and control means for alternatingly operating said yarn steaming devices of said two machine sides, said two yarn steaming device including a common middle wall, a steam pipe disposed in said common middle wall swiveling about a longitudianl axis thereof, two pipes branching from said steam pipe and having ends, and respective rows of yarn steaming elements disposed at said ends of said two pipes, said automatic switching and control means lifting said yarn steaming elements of one machine side off the ends of the tubes or sleeves when said yarn steaming elements of the other machine side are near the ends of the tubes or sleeves.

* * * * *